US008193872B2

(12) United States Patent
Ikoma et al.

(10) Patent No.: US 8,193,872 B2
(45) Date of Patent: Jun. 5, 2012

(54) WAVEGUIDE CIRCULATOR

(75) Inventors: Toshiharu Ikoma, Tokyo (JP); Mina Iwama, Tokyo (JP)

(73) Assignee: SPC Electronics Corporation, Tokyo (JP)

( * ) Notice: Subject to any disclaimer, the term of this patent is extended or adjusted under 35 U.S.C. 154(b) by 242 days.

(21) Appl. No.: 12/702,928

(22) Filed: Feb. 9, 2010

(65) Prior Publication Data

US 2010/0207701 A1 Aug. 19, 2010

(30) Foreign Application Priority Data

Feb. 10, 2009 (JP) ..... 2009-28110

(51) Int. Cl.
*H01P 1/39* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS

| | | | | |
|---|---|---|---|---|
| 3,714,608 | A * | 1/1973 | Barnes et al. | 333/1.1 |
| 4,280,111 | A * | 7/1981 | Forterre et al. | 333/1.1 |
| 2006/0232353 | A1 | 10/2006 | Kroeing | |

FOREIGN PATENT DOCUMENTS

| | | | |
|---|---|---|---|
| EP | 0278867 | A1 | 8/1988 |
| EP | 1435123 | B1 | 1/2008 |
| JP | 47-20429 | | 7/1972 |
| JP | 48-17246 | | 3/1973 |
| JP | 57-41302 | | 3/1982 |
| JP | 58-131803 | A | 8/1983 |
| JP | 7-307602 | | 11/1995 |
| JP | 2005-505977 | | 2/2005 |

OTHER PUBLICATIONS

Helszajn, "Common Waveguide Circulator Configurations," Electronic Engineering, Sep. 1, 1974, pp. 66/67, 69, Morgan-Grampian LTD., London, GB.

* cited by examiner

*Primary Examiner* — Stephen Jones
(74) *Attorney, Agent, or Firm* — Muncy, Geissler, Olds & Lowe, PLLC

(57) ABSTRACT

A waveguide circulator which does not cause an arcing phenomenon and deterioration of microwave characteristic, even when a ferrite member generates heat to raise a temperature thereof. The waveguide circulator is composed of a waveguide formed substantially in Y-shape with rectangular waveguides which are provided so as to position horizontally on a predetermined plane, and further they are extended in different three directions from junction positions of the waveguide wherein two ferrite members are placed in the junction positions thereof so as to oppose to each other on the upper and lower sides in the height direction perpendicular to the predetermined plane wherein an extended section extending in the height direction in the vicinities of the junction positions of the waveguides is formed, and a distance between the ferrite members is expanded to compensate decreased impedance.

21 Claims, 13 Drawing Sheets

FIG. 6

| | INSERTION LOSS | FRACTIONAL BANDWIDTH | HEATING VALUE OF FERRITE MEMBER | TEMPERATURE OF FERRITE MEMBER |
|---|---|---|---|---|
| WAVEGUIDE CIRCULATOR 10 | 0.15dB | 3% or less | 270W | 82°C |
| WAVEGUIDE CIRCULATOR 30 | 0.08dB | 10% or more | 150W | 65°C |

UPPER SIDE

LOWER SIDE

HEIGHT DIRECTION

WAVEGUIDE CIRCULATOR

BACKGROUND OF THE INVENTION

1. Field of the Invention

The present invention relates to a waveguide circulator, and more particularly to a three-junction waveguide circulator used suitably for high-power microwave.

2. Description of the Related Art

In recent years, it is known that a field wherein microwave power is used becomes expanded widely over various industrial fields.

Particularly, since electric power to be applied is raised from several kW to around several MW in a frequency band of UHF band or a higher band, it is desired to develop a high-performance circulator which can respond to such a large amount of power as described above.

In the following, a conventional waveguide circulator will be described by referring to FIGS. 1(*a*) and 1(*b*).

Namely, FIG. 1(*a*) is a plane explanatory view showing a conventional three-junction waveguide circulator, and FIG. 1(*b*) is a sectional explanatory view taken along line A-A of FIG. 1(*a*).

The conventional three-junction waveguide circulator 10 shown in FIGS. 1(*a*) and 1(*b*) is composed of a waveguide 12 formed substantially in Y-shape with rectangular waveguides 12-1, 12-2, and 12-3 which are provided so as to position horizontally on a predetermined plane, and further they are extended in different three directions from positions of the junctions, respectively; a cylindrical column-shaped pedestal 14 disposed on the undersurface 12*aa* of the waveguide 12 in the junction positions in an inner circumferential surface 12*a* thereof; a column-shaped pedestal 16 disposed on the upper surface 12*ab* of the waveguide 12 in the junction positions in the inner circumferential surface 12*a* so as to be opposed to the upper surface 14*a* of the pedestal 14; a circular disc-shaped ferrite member 18 adhesively fixed on the upper surface 14*a* of the pedestal 14; and a circular disc-shaped ferrite member 20 adhesively fixed on the under-surface 16*a* of the pedestal 16.

According to the above-described construction, an S-pole magnet 22 is placed under the lower side of the position at which the pedestal 14 is disposed so as not to be in contact with the outer circumferential surface 12*b* of the waveguide 12, and further an N-pole magnet 24 is placed over the upper side of the position at which the pedestal 16 is disposed so as not to be in contact with the outer circumferential surface 12*b* of the waveguide 12 outside the same in the waveguide circulator 10.

Magnetic field is induced by the S-pole magnet 22 and the N-pole magnet 24 in the junction positions of the waveguide 12, whereby the ferrite members 18 and 20 fixed adhesively to the pedestals 14 and 16, respectively, are magnetized.

In these circumstances, when electromagnetic wave such as microwave passes through the junction positions in which the ferrite members 18 and 20 under the magnetized state are positioned, a course of the electromagnetic wave passed through the junction positions is curved diagonally forward left while keeping polarization plane horizontal.

More specifically, when the electromagnetic wave which enters through the rectangular waveguide 12-1 passes through the junction position at which the ferrite members 18 and 20 are positioned wherein these ferrite members 18 and 20 have been in magnetized state, the electromagnetic wave which was thus passed through the junction position goes into the rectangular waveguide 12-2.

In a similar fashion, when the electromagnetic wave which enters through the rectangular waveguide 12-2 passes through the junction position at which the ferrite members 18 and 20 are positioned wherein these ferrite members 18 and 20 have been in magnetized state, the electromagnetic wave which was thus passed through the junction position goes into the rectangular waveguide 12-3.

Furthermore, in like wise, when the electromagnetic wave which enters through the rectangular waveguide 12-3 passes through the junction position at which the ferrite members 18 and 20 are positioned wherein these ferrite members 18 and 20 have been in magnetized state, the electromagnetic wave which was thus passed through the junction position goes into the rectangular waveguide 12-1.

However, the ferrite members 18 and 20 generate heat due to the heat generated by internal insertion loss of the ferrite members with increase of electric power applied in the above-described waveguide circulator 10.

Thus, there is such a problem that when the ferrite members 18 and 20 generate heat, saturation magnetization 4 $\pi$Ms in the ferrite members 18 and 20 decreases, whereby microwave characteristic in the waveguide circulator 10 becomes inferior.

Furthermore, there is such another problem that when electric power to be applied in the waveguide circulator 10 increases, arcing (abnormal discharge) phenomenon appears between the ferrite members 18 and 20.

In this connection, it is known that a distance between the ferrite members 18 and 20 is constructed so as to extend as a countermeasure therefore as a countermeasure for the above-mentioned arcing phenomenon.

Referring to FIG. 2, there is shown an equivalent circuit diagram of an ideal waveguide circulator. An explanation is made with reference to FIG. 2 wherein when a distance between the ferrite members 18 and 20 is extended as a countermeasure for arcing phenomenon, stray capacitance C between the ferrite members 18 and 20 becomes small.

As described above, as a result of reduction of the stray capacitance C between the ferrite members 18 and 20, there is such a problem that impedance inside the waveguide circulator 10 decreases, so that fractional bandwidth of bandpass wherein a return loss is 26 dB or less becomes 3% or less, whereby the fractional bandwidth becomes narrow, even if an adjustment is made by a capacitive device or an inductive device from the outside of the waveguide circulator 10.

In other words, the following problems are pointed out with respect to a conventional waveguide circulator. In the conventional waveguide circulator, ferrite members generate heat with increase of electrical power to be applied, and it results in temperature rise of the ferrite members. For a countermeasure against arcing phenomenon, when a distance between ferrite members is extended sufficiently in such degree that no arcing phenomenon arises, a stray capacitance between the ferrite members becomes small. As a result, saturation magnetization 4 $\pi$ Ms in the ferrite members decreases, and in addition, it results in deterioration of microwave characteristic such as deterioration of return loss and isolation.

It is to be noted that since the prior art concerning the present invention does not relate to an invention known to the public through publication, there is no information as to prior art literary document published to be described herein at the time when the present application was filed by the present applicants.

OBJECT AND SUMMARY OF THE INVENTION

The present invention has been made in view of the above-described various problems involved in the prior art, and an object of the invention is to provide a waveguide circulator which does not cause arcing phenomenon and deterioration of microwave characteristic, even if ferrite members applied generate heat to raise a temperature thereof.

In order to achieve the above-described objects, the waveguide circulator according to the present invention is arranged in such that insertion loss of ferrite members is reduced to expand a range of return loss and isolation, thereby not causing deterioration of microwave characteristic, even if the ferrite members generate heat to raise a temperature thereof.

Namely, the present invention may be a waveguide circulator composed of a waveguide formed substantially in Y-shape with rectangular waveguides which are provided so as to position horizontally on a predetermined plane, and further they are extended in different three directions from junction positions of the waveguide in which two ferrite members are placed in the junction positions thereof so as to oppose to each other on the upper and lower sides in the height direction perpendicular to the predetermined plane; wherein an extended section extending in the height direction in the vicinities of the junction positions of the waveguides is formed; and a distance between the ferrite members is expanded to compensate decreased impedance.

Furthermore, at least one of the ferrite members may be adhesively fixed to a pedestal disposed in the junction positions of the waveguide in the above-described waveguide circulator according to the present invention.

Moreover, the present invention may be a waveguide circulator composed of a waveguide formed substantially in Y-shape with rectangular waveguides which are provided so as to position horizontally on a predetermined plane, and further they are extended in different three directions from junction positions of the waveguide in which a ferrite member is disposed on either of pedestals placed on the upper and lower sides in the height direction perpendicular to the predetermined plane in the junction positions thereof; wherein an extended section extending in the height direction in the vicinities of the junction positions of the waveguides is formed; and a distance between the ferrite member and the pedestal opposed thereto is expanded to compensate decreased impedance.

Still further, the present invention may be a waveguide circulator composed of a waveguide formed substantially in Y-shape with rectangular waveguides which are provided so as to position horizontally on a predetermined plane, and further they are extended in different three directions from junction positions of the waveguide in which a ferrite member is disposed on either of pedestals placed on the upper and lower sides in the height direction perpendicular to the predetermined plane in the junction positions thereof; wherein an extended section extending in the height direction in the vicinities of the junction positions of the waveguides is formed; and a distance between the ferrite member and an inner circumferential surface of the extended section opposed to the ferrite member is expanded to compensate decreased impedance.

Yet further, the extended section may be extended in the height direction in positions apart from the center of the junction positions by ⅛ λg to λg (λg: guide wavelength of a rectangular waveguide) in the respective rectangular waveguides of the waveguide circulators according to the above-described respective inventions.

Furthermore, the extended section may be extended in the height direction toward only either one of the upper and lower sides in the waveguide circulators according to the above-described respective inventions.

Moreover, the extended section may be extended in the height direction in the vicinities of the junction positions of the waveguide to form a step on either one of the upper and lower sides of the waveguide; and the step may be formed to be a plurality of steps in the waveguide circulator according to the above-described invention.

Still further, the extended section may be extended in the height direction in the vicinities of the junction positions of the waveguide to form steps on the upper and lower sides of the waveguide; and the steps may be formed into a tapered shape in the waveguide circulators according to the above-described respective inventions.

Yet further, the extended section may be extended in the height direction in the vicinities of the junction positions of the waveguide to form steps on the upper and lower sides of the waveguide; and the steps may be positioned so as not to oppose to each other in the waveguide circulators according to the above-described respective inventions.

Moreover, a cooling medium may be provided on the outer circumferential surface of the waveguide in the waveguide circulators according to the above-described respective inventions.

Since the present invention has been constructed as described hereinabove, the waveguide circulator according to the invention achieves such excellent advantageous effects that even if ferrite members generate heat to raise a temperature of the waveguide circulator, it causes neither arcing phenomenon, nor deterioration of microwave characteristic.

Therefore, the present invention as described herein is preferably applied to a circulator for protecting an oscillator and the like used in an accelerator, a radar or the like.

BRIEF DESCRIPTION OF THE DRAWING

The present invention will become more fully understood from the detailed description given hereinbelow and the accompanying drawing which is given by way of illustration only, and thus is not limitative of the present invention, and wherein:

FIG. 1(*b*) is a sectional explanatory view taken along line A-A of FIG. 1(*a*).

FIG. 3(*b*) is a sectional explanatory view taken along line B-B of FIG. 3(*a*).

FIG. 5(*b*) is an explanatory view showing the waveguide circulator which is provided with the extended section according to the present invention.

FIG. 6 is a table showing experimental results of the effects obtained by comparing the conventional waveguide circulator which is not provided with the extended section with the waveguide circulator of the invention which is provided with the extended section.

FIG. 7(*b*) is a graph showing isolation with respect to frequency of a microwave input to the conventional waveguide circulator, which is not provided with the extended section, before and during high-power application.

FIG. 8(*b*) is a graph showing isolation with respect to frequency of a microwave input to the waveguide circulator, which is provided with the extended section according to the invention, before and during high-power application.

FIG. 10(*b*) is a sectional explanatory view along line C-C of FIG. 10(*a*).

DETAILED DESCRIPTION OF THE PREFERRED EMBODIMENTS

In the following, an example of preferred embodiments of the waveguide circulator according to the present invention will be described in detail by referring to the accompanying drawings.

Figure 1:
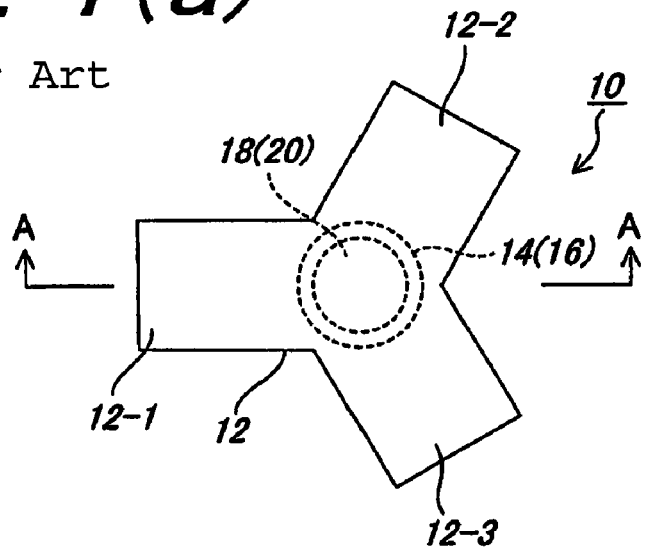
FIG. 1 (a) Prior Art
FIG. 1(*a*) is a plan explanatory view showing a conventional waveguide circulator.
Figure 1:
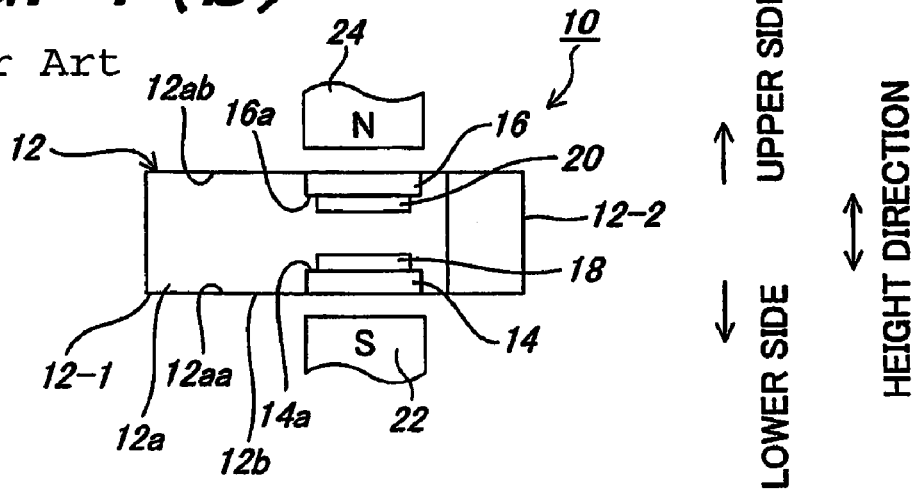
FIG. 1 (b) Prior Art
Figure 2:
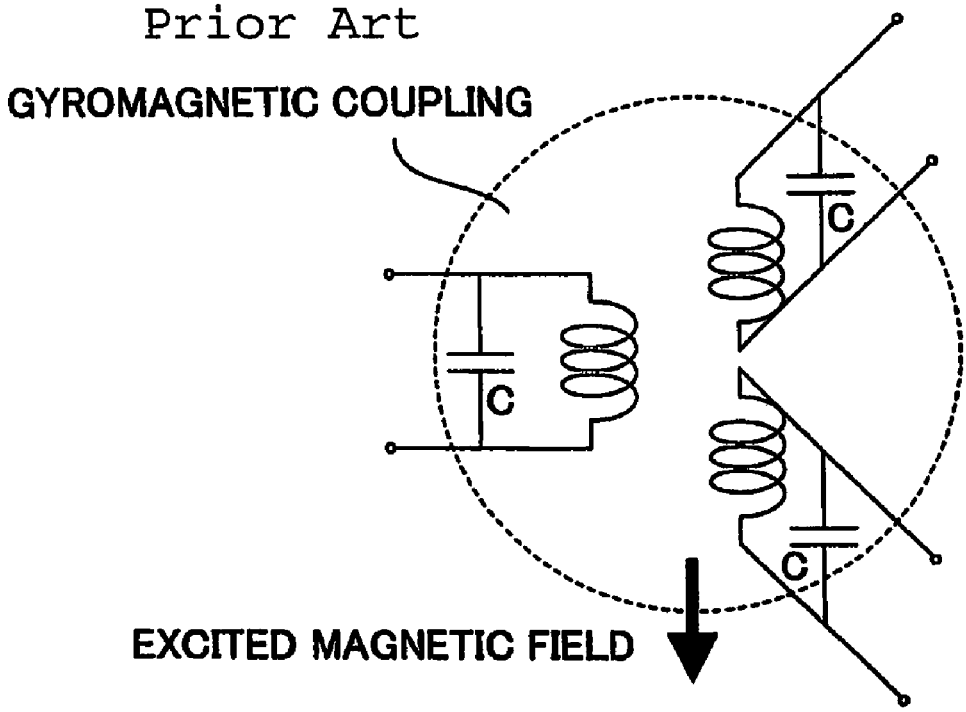
FIG. 2 Prior Art
FIG. 2 is an equivalent circuit diagram of a conventional waveguide circulator.

In the following description, a detailed construction and a description of functions and advantageous effects of a waveguide circulator will be optionally omitted with respect to the same or equivalent construction as or to that of the conventional waveguide circulator described by referring to FIGS. 1(*a*) and 1(*b*) through the explanation with the use of the same reference numerals as that used in the above description relating to the conventional waveguide circulator.

First, an example of preferred embodiments of the waveguide circulator according to the present invention will be described hereinbelow by referring to FIGS. 3(*a*) and 3(*b*) wherein FIG. 3(*a*) is a plan explanatory view showing a three-junction waveguide circulator according to the present invention; and FIG. 3(*b*) is a sectional explanatory view taken along line B-B of FIG. 3(*a*).

Figure 3A:
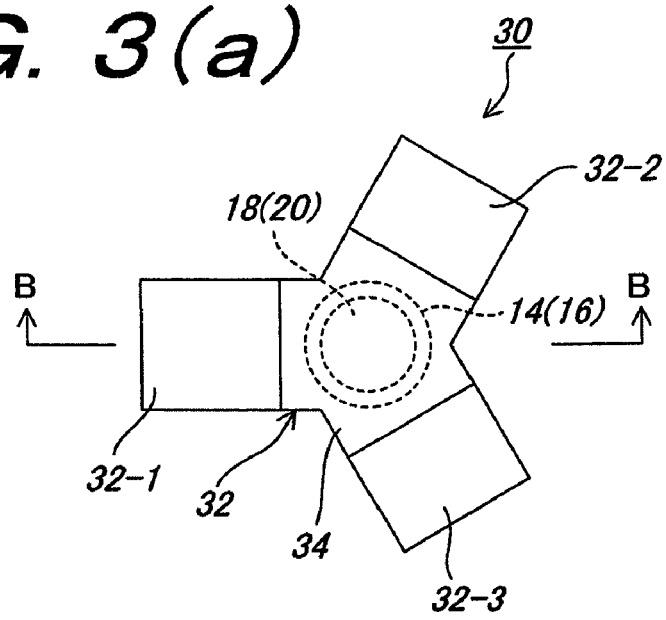
FIG. 3(*a*) is a plan explanatory view showing a waveguide circulator according to the present invention.
Figure 3B:
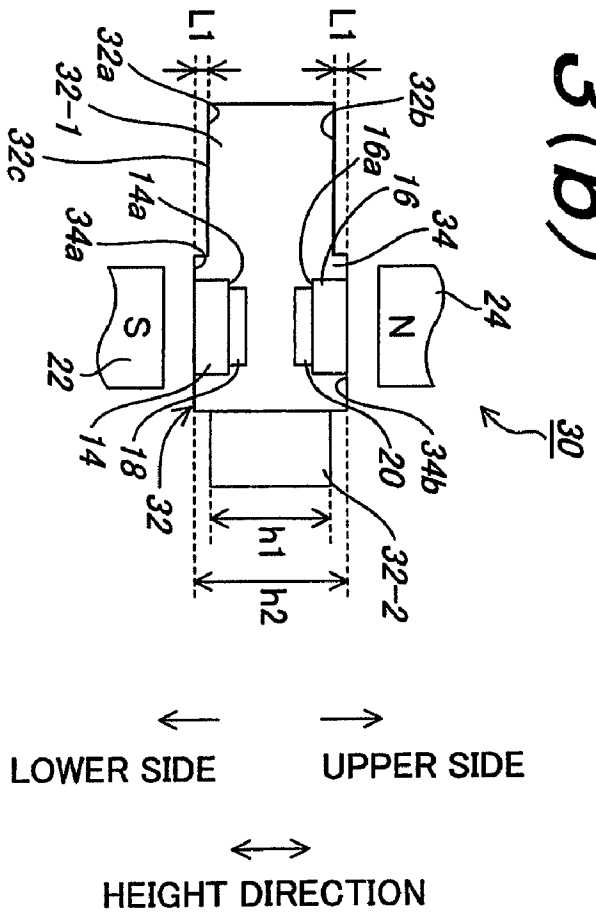

The waveguide circulator 30 shown in FIGS. 3(*a*) and 3(*b*) is composed of a waveguide 32 formed substantially in Y-shape with rectangular waveguides 32-1, 32-2, and 32-3 which are provided so as to position horizontally on a predetermined plane, and further they are extended in different three directions from positions of the junctions, respectively, the waveguide 32 being provided with an extended section 34 which is formed by extending the undersurface 32*a* and the upper surface 32*b* of the inner circumferential plane of the waveguide 32 in height direction thereof in the vicinities of junction positions of the rectangular waveguides; a cylindrical column-shaped pedestal 14 disposed on the undersurface 34*a* of the extended section 34 in the junction positions of the waveguide 32; a column-shaped pedestal 16 disposed on the upper surface 34*b* of the extended section 34 in such that the undersurface 16*a* is opposed to the upper surface 14*a* of the pedestal 14 in the extended section 34 in the junction positions of the waveguide 32; a circular disc-shaped ferrite member 18 adhesively fixed to the upper surface 14*a* of the pedestal 14; and a circular disc-shaped ferrite member 20 adhesively fixed to the undersurface 16*a* of the pedestal 16.

Furthermore, the waveguide 32 is provided with a cooling medium (not shown) on the outer circumferential surface 32*c* thereof for heat dissipation of the waveguide 32.

Moreover, the extended section 34 is formed with the rectangular waveguides 32-1, 32-2, and 32-3 in a height h2 wherein the height h1 of each of the rectangular waveguides 32-1, 32-2, and 32-3 is extended by a length L1 toward the upper and lower sides on the basis of the height h1, respectively, in the vicinities of the junction positions.

More specifically, the extended section 34 is extended toward the upper and lower sides at a position apart from the center of the junction positions by ⅛ λg to λg (λg: guide wavelength of the rectangular waveguide), respectively in the rectangular waveguides 32-1, 32-2, and 32-3.

Such length L1 or the positions to be extended in the respective rectangular waveguides 32-1, 32-2, and 32-3 are determined dependent on such impedance which decreases due to a stray capacitance C decreased as a result of providing the extension of a distance between the ferrite members 18 and 20.

In the waveguide circulator 30, first, a distance between the ferrite members 18 and 20 is determined so as not to appear arcing phenomenon between the ferrite members 18 and 20 due to a magnitude of electric power to be applied. Thereafter, thicknesses of the ferrite members 18 and 20 as well as an amount of the extension toward the upper and lower sides of the extended section 34 are determined.

Then, each height of the pedestals is determined in such that a distance determined is maintained by the ferrite members 18 and 20.

A position to be extended in the extended section 34 and a dimension of the length L1 can be experimentally determined through, for example, an experimental prototype and the like.

In the above-described construction, the S-pole magnet 22 is disposed under the lower side of the position at which the pedestal 14 is provided (i.e. the lower side of the extended section 34) and outside the waveguide 32 so as not to be in contact with the outer circumferential surface 32*c* of the waveguide 32 in the waveguide circulator 30. On the other hand, an N-pole magnet 24 is disposed over the upper side of the position at which the pedestal 16 is provided (i.e. the upper side of the extended section 34) and outside the waveguide 32 so as not to be in contact with the outer circumferential surface 32*c* of the waveguide 32. In this arrangement, magnetic field is induced in the junction positions of the waveguide 32 to magnetize the ferrite members 18 and 20 fixed adhesively to the pedestals 14 and 16, respectively.

As a result, when electromagnetic wave such as microwave passes through the junction positions in which the ferrite members 18 and 20 under magnetized state are positioned, a course of the electromagnetic wave passed through the junction positions is curved diagonally forward left while keeping polarization plane horizontal.

More specifically, when the electromagnetic wave which enters through the rectangular waveguide 32-1 passes through the junction position at which the ferrite members 18 and 20 are positioned wherein these ferrite members 18 and 20 have been in the magnetized state, the electromagnetic wave which was thus passed through the junction position goes through the rectangular waveguide 32-2.

In a similar fashion, when the electromagnetic wave which enters through the rectangular waveguide 32-2 passes through the junction position at which the ferrite members 18 and 20 are positioned wherein these ferrite members 18 and 20 have been in the magnetized state, the electromagnetic wave which was thus passed through the junction position goes through the rectangular waveguide 32-3.

Furthermore, in like wise, when the electromagnetic wave which enters through the rectangular waveguide 32-3 passes through the junction position at which the ferrite members 18 and 20 are positioned wherein these ferrite members 18 and 20 have been in the magnetized state, the electromagnetic wave which was thus passed through the junction position goes through the rectangular waveguide 32-1.

In the waveguide circulator 30, since the ferrite member 18 is disposed apart from the ferrite member 20 while maintaining a distance in such degree that no arcing phenomenon appears, a stray capacitance C between the ferrite members 18 and 20 decreases, so that impedance inside the waveguide circulator 30 becomes low.

In the waveguide circulator 30, such lowered impedance is compensated by forming the extended section 34 in the junction positions in which the ferrites 18 and 20 are positioned.

As described above, the ferrite members 18 and 20 are disposed while maintaining an extended distance therebetween so as not to cause arcing phenomenon in the waveguide circulator 30. As a result, impedance inside the waveguide circulator 30 decreases, whilst the impedance inside the waveguide circulator 30 is elevated by forming the extended section 34 in the junction positions.

According to the construction as described above, it is arranged in such that impedance inside the waveguide circulator 30 is not changed.

Figure 4:
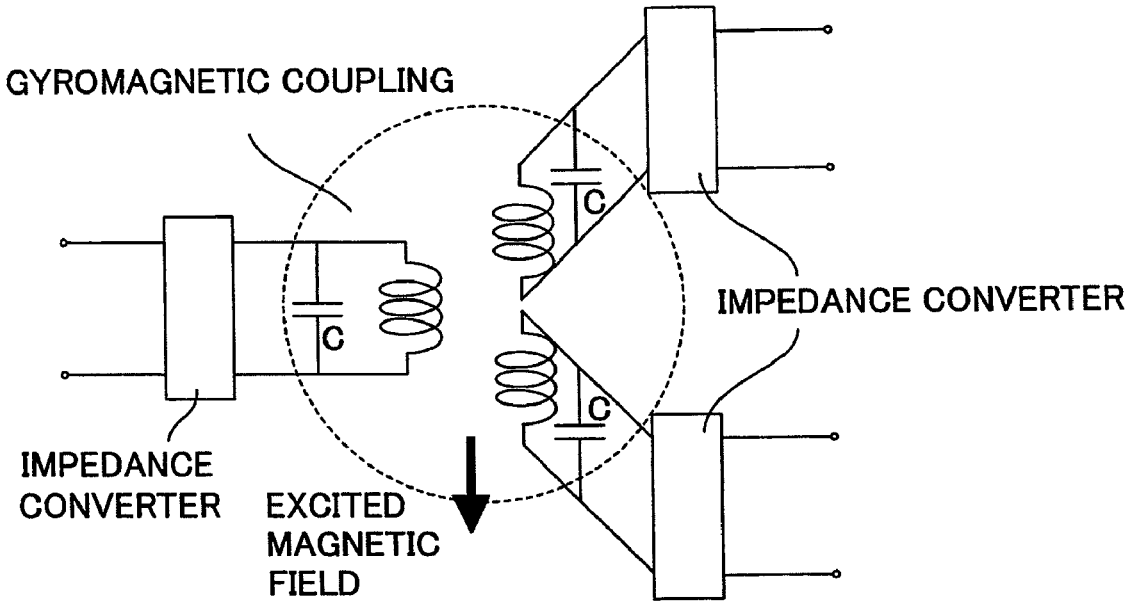
FIG. 4 is an equivalent circuit diagram of the waveguide circulator according to the present invention.

In other words, the extended section 34 functions as an impedance transformer section in the waveguide circulator 30 as in the equivalent circuit shown in FIG. 4, so that impedance matching is effected by the extended section 34 functioning as the impedance transformer section.

As a result of providing the extended section 34 in the waveguide circulator 30, current density in the ferrite members 18 and 20 decreases, so that insertion loss decreases.

Thus, when insertion loss in the waveguide circulator 30 is reduced, heat generation in the ferrite members 18 and 20 is suppressed. Accordingly, temperature rise of the ferrite members 18 and 20 is suppressed in case of applying a large amount of electric power, whereby decrease of saturation magnetization 4 $\pi$Ms in the ferrite members 18 and 20 is suppressed.

Next, results of the experiments which are made by the inventors of the present application with respect to the above-described conventional waveguide circulator 10 and the waveguide circulator 30 will be described in detail hereunder.

More specifically, insertion loss, fractional bandwidth, heating value in ferrite members, ferrite temperature, and return loss as well as isolation with respect to frequency of microwave input were measured by using the conventional waveguide circulator 10 which is not provided with the extended section 34 and the waveguide circulator 30 provided with the extended section 34 according to the present invention for the sake of confirming advantageous effects of the extended section 34 in the experiments.

In the waveguide circulator 30 according to the present invention used in the experiment, the extended section 34 is formed by extending the section in each height direction of the rectangular waveguides 32-1, 32-2, and 32-3 by 1.5 to 1.7 times longer, and further extending the section toward the upper and lower sides at each of junction positions which are apart from the centers of the rectangular waveguides 32-1, 32-2, and 32-3 by ⅛ $\lambda$g to $\lambda$g ($\lambda$g: guide wavelength of a rectangular waveguide), respectively. It is to be noted that the waveguide circulator 30 of the present invention differs only from the conventional waveguide circulator 10 used in the experiment in the above-described points.

Figure 5A:
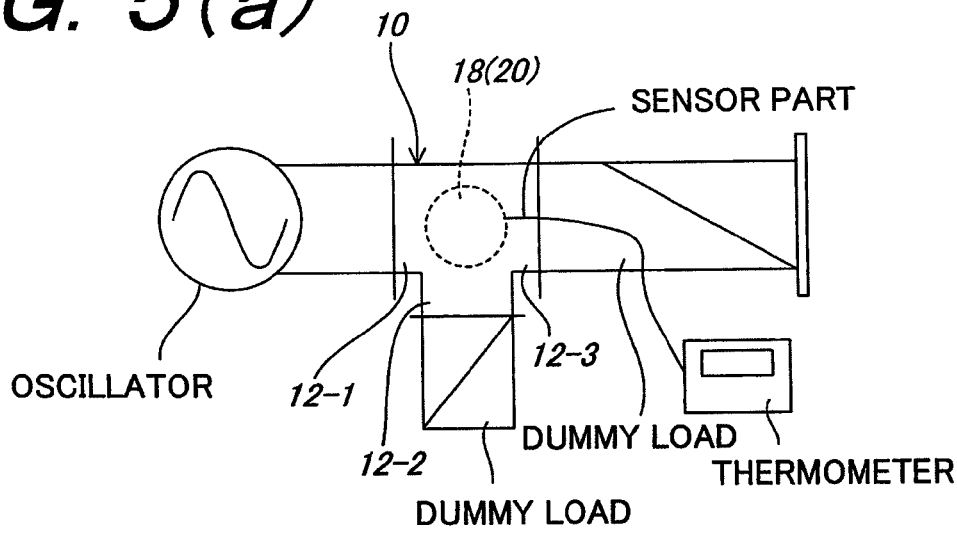
FIGS. 5(*a*) and 5(*b*) are explanatory views each showing an experimental system for experiments practiced by the present inventors wherein FIG. 5(*a*) is an explanatory view showing a conventional waveguide circulator which is not provided with an extended section.
Figure 5B:
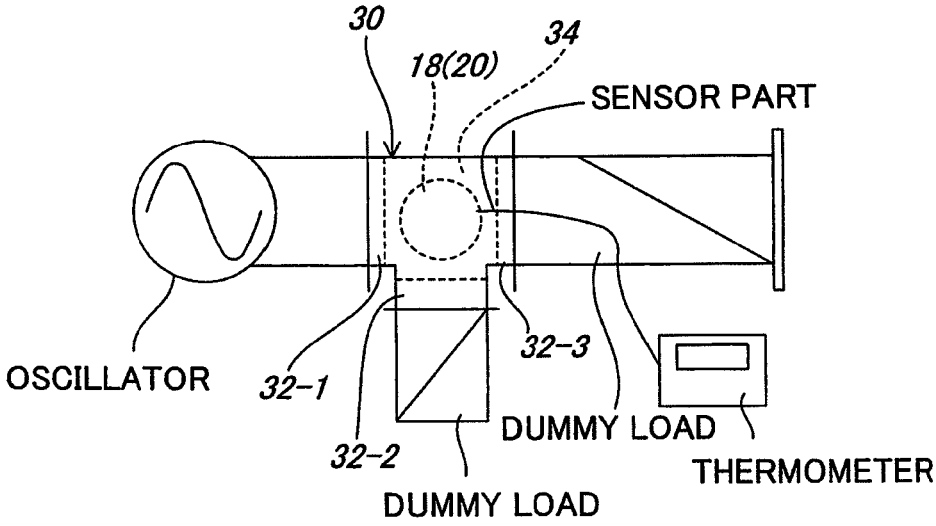

As shown in FIG. 5(*a*), the conventional waveguide circulator 10 is arranged in such that an oscillator is placed in such a manner that microwave is input from the rectangular waveguide 12-1; and further, it is arranged in such that dummy loads are disposed on the rectangular waveguides 12-2 and 12-3, respectively, and a sensor part of a thermometer introduced from the dummy load which is disposed on the rectangular waveguide 12-3 is fixed to the surface of a ferrite member.

In a similar way, as shown in FIG. 5(*b*), the waveguide circulator 30 of the present invention is arranged in such that an oscillator is placed in such a manner that microwave is input from the rectangular waveguide 32-1, and further, it is arranged in such that dummy loads are disposed on the rectangular waveguides 32-2 and 32-3, respectively, and a sensor part of a thermometer introduced from the dummy load disposed on the rectangular waveguide 32-3 is fixed to the surface of a ferrite member.

Under the condition that each of temperatures in the ferrite members 18 and 20 is made to be 40° C. by the use of a cooling medium disposed on each of the outer circumferential surfaces of both the waveguide circulators 10 and 30, insertion loss, fractional bandwidth, heating value in ferrite members, and temperature of ferrite members in the case that electric power of 8 kW is applied to the waveguide circulators 10 and 30, respectively, were measured.

Furthermore, under the condition that a temperature of ferrite members is raised up to the temperature which is measured in the case that electric power of 8 kW was applied, return loss and isolation with respect to frequencies (2.78 to 2.92 GHz) of microwave to be input were measured.

In this case, insertion loss, fractional bandwidth; return loss and isolation with respect to frequencies of microwave to be input were measured by the use of a network analyzer.

Heating value in ferrite members were calculated from magnitude of electric power to be applied and insertion loss.

Moreover, temperature of ferrite members was measured by either using thermal analysis software ("STREAM" made by CRADLE Co.) from the heating value calculated, or measuring actually by the use of a temperature sensor with taking coefficients of thermal conductivity of ferrite members, pedestals, an adhesive for fixing adhesively the ferrite members to the pedestals and the like into consideration.

Next, FIG. 6 to FIGS. 8(*a*) and 8(*b*) show experimental results of experiments practiced by the inventors of the present application and the experimental results will be described hereinbelow.

FIG. 6 shows insertion loss, fractional bandwidth, heating value in ferrite members, and temperature of the ferrite members in the waveguide circulators 10 and 30, respectively, in the case that electric power of 8 kW is applied.

Under the condition that temperatures of the ferrite members 18 and 20 are kept at 40° C. in actual measurement value by means of a thermometer, 8 kW electric power is applied to the waveguide circulator 10. As a result, insertion loss, fractional bandwidth, and heating value were 0.15 dB, 3% or less, and 270 W, respectively, and the temperatures of the ferrite members rise up to 82° C. in actual measurement value by means of a thermometer.

On one hand, when 8 kW electric power is applied to the waveguide circulator 30 under the same condition as that described above, insertion loss, fractional bandwidth, and heating value were 0.08 dB, 10% or more, and 150 W, respectively, and the temperatures of the ferrite members rise up to 65° C. in actual measurement value by means of a thermometer.

For this reason, in the present experiment, temperature of the ferrite members is warmed to 82° C. in the conventional waveguide circulator 10, while temperature of the ferrite members is warmed to 65° C. in the waveguide circulator 30, respectively, and in this condition, insertion loss, fractional bandwidth as well as return loss and isolation with respect to frequencies of microwave to be input were measured by means of a network analyzer, respectively.

Figure 7A:
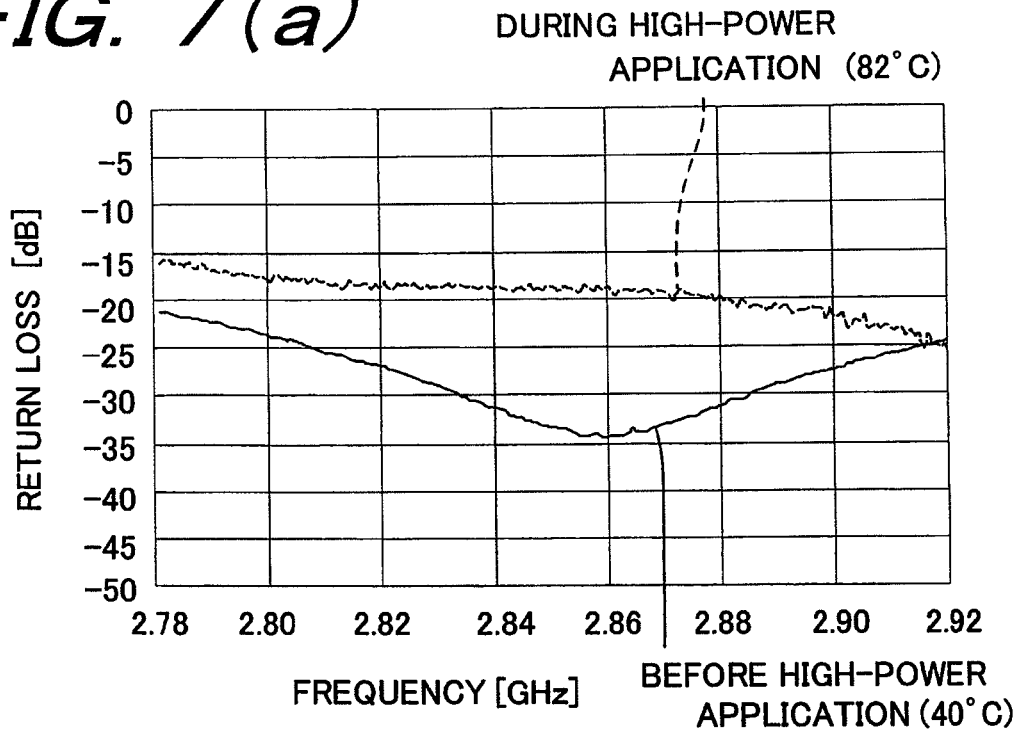
FIG. 7(*a*) is a graph showing return loss with respect to frequency of a microwave input to a conventional waveguide circulator, which is not provided with the extended section, before and during high-power application.
Figure 7B:
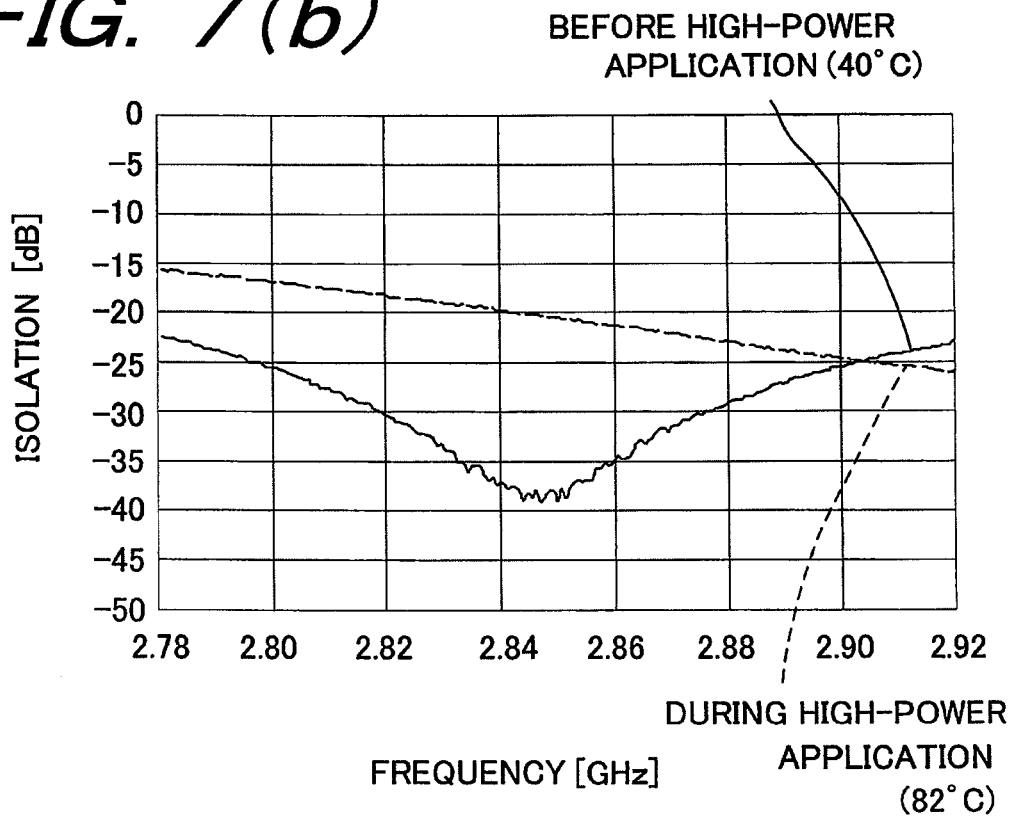

FIGS. 7(*a*) and 7(*b*) show measurement results of return loss and isolation with respect to frequencies of microwave to be input in the waveguide circulator 10 wherein temperature of the ferrite members are raised up to 82° C.

Figure 8A:
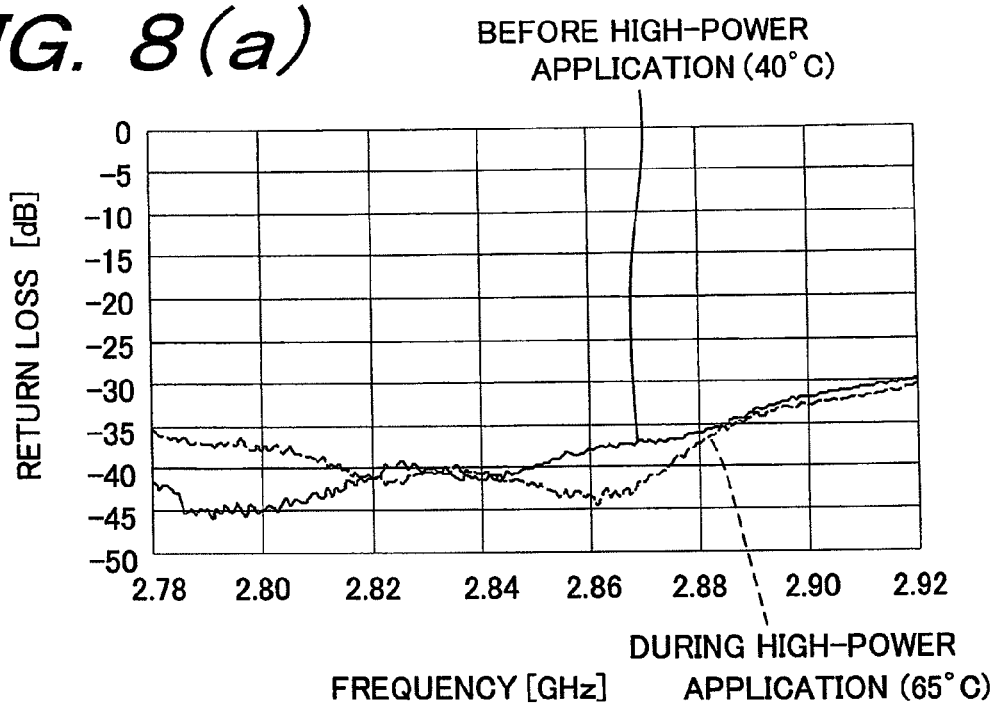
FIG. 8(*a*) is a graph showing return loss with respect to frequency of a microwave input to the waveguide circulator, which is provided with the extended section according to the present invention, before and during high-power application.
Figure 8B:
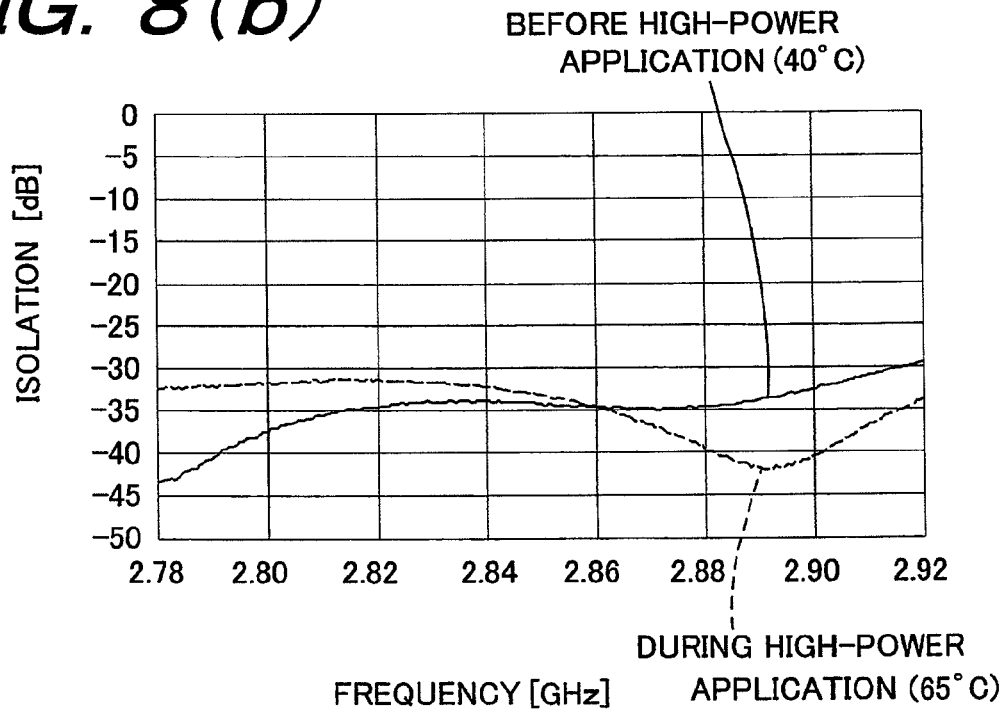

On one hand, FIGS. 8(*a*) and 8(*b*) show measurement results of return loss and isolation with respect to frequencies of microwave to be input in the waveguide circulator 30 wherein temperature of the ferrite members are raised up to 65° C.

In these circumstances, the higher value of return loss results in the smaller electric power to be reflected to the side of an oscillator as reflected power. Accordingly, it is desirable to take a higher value of return loss. If a value of return loss is lower than a predetermined value, reflected power becomes large, and resulting in a cause for malfunction of the oscillator.

With taking such points as described above into consideration, a value of 26 dB which may be considered to be a value commonly used for protecting the oscillator is used in the present experiment, and it is measured that values of return loss and isolation vary in what way in the waveguide circulators 10 and 30 dependent on variations of frequencies of microwave to be input before and during application of a large amount of power.

In the conventional waveguide circulator 10, when a large amount of power is applied, temperature of the ferrite members rises up to 82° C., so that saturation magnetization 4 πMs in the ferrite members decreases.

Hence, as shown in FIG. 7(*a*), although return loss is around 33 dB, for example, in the case that microwave of 2.85 GHz is input to the conventional waveguide circulator 10 before applying a large amount of power (temperature of ferrite members=40° C.), return loss becomes around 19 dB during application of a large amount of power (temperature of ferrite members=82° C.).

On the other hand, when a large amount of power is applied in the waveguide circulator 30 according to the present invention, temperature of the ferrite members rises to 65° C., but the temperature rise is small.

Thus, as shown in FIG. 8(*a*), when microwave of, for example, 2.85 GHz is input to the waveguide circulator 30 of the present invention, return loss is around 40 dB before application of a large amount of power (temperature of ferrite members=40° C.), whilst return loss becomes around 42 dB during application of a large amount of power (temperature of ferrite members=65° C.).

Namely, a case in which return loss reaches to 26 dB or more is limited to a frequency range of from 2.81 to 2.91 GHz in the conventional waveguide circulator 10 before applying a large amount of electric power, and when a large amount of power is further applied, return loss becomes always 26 dB or less.

Accordingly, when a large amount of electric power is applied in the conventional waveguide circulator 10, reflected power reflecting to the side of an oscillator increases, and resulting in a cause for malfunction of the oscillator.

On the other hand, return loss becomes 26 dB or more in the whole range (2.78 to 2.92 GHz) in the waveguide circulator 30 according to the present invention before applying a large amount of electric power, and even when a large amount of power is further applied, return loss is kept always in 26 dB or more.

Thus, even if a large amount of electric power is applied in the waveguide circulator 30 of the present invention, a reflected power reflecting to the side of an oscillator is small, so that the waveguide circulator can be used with accompanying no adverse effect to the oscillator.

Moreover, in the conventional waveguide circulator 10, isolation shows 22 to 39 dB before application of a large amount of power (temperature of ferrite members=40° C.), whilst isolation shows 15 to 26 dB during application of a large amount of power (temperature of ferrite members=82° C.), respectively, as shown in FIG. 7(*b*). Hence, application of a large amount of power results in remarkable decrease of isolation in the conventional waveguide circulator 10.

On one hand, in the waveguide circulator 30 according to the present invention, isolation shows 31 to 42 dB before application of a large amount of power (temperature of ferrite members=40° C.), whilst isolation shows 29 to 43 dB during application of a large amount of power (temperature of ferrite members=65° C.), respectively, as shown in FIG. 8(*b*). Accordingly, even if a large amount of power is applied, substantially no decrease of isolation is observed in the waveguide circulator 30.

In other words, it means that high isolation is obtained always in broad band in the waveguide circulator 30 of the present invention.

As described above, the waveguide circulator 30 is provided with the extended section 34 in junction positions of the waveguide 32, whereby impedance inside the waveguide circulator 30 is matched.

Figure 9:
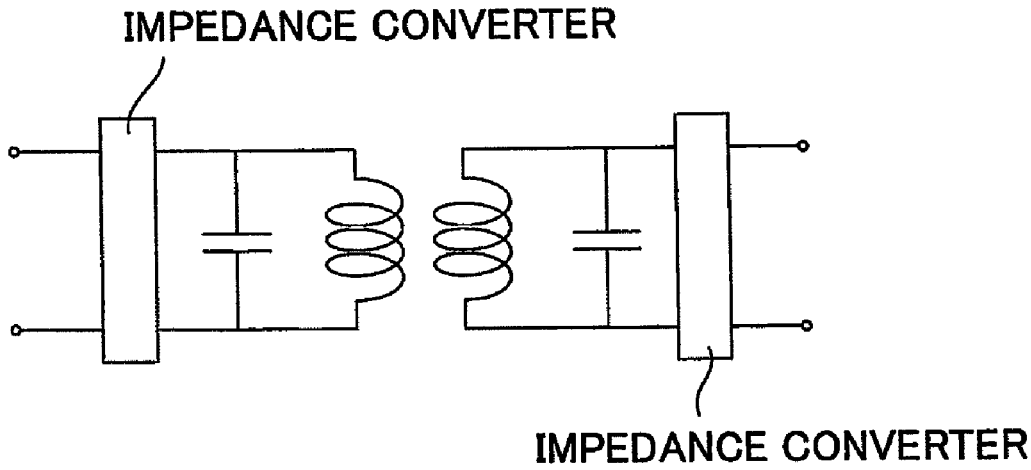
FIG. 9 is an equivalent circuit diagram for showing pass characteristic in the waveguide circulator according to the invention.

According to the present invention, isolation is high in broad band, so that electric power leaking in isolation end in ordinary band becomes small. Accordingly, it becomes possible to handle an equivalent circuit as to pass characteristic as the two terminal network shown in FIG. 9, but not the three terminal network shown in FIG. 4. Hence, the present invention exhibits characteristics of high return loss and high isolation in broad band.

Furthermore, since the waveguide circulator 30 is provided with the extended section 34, current density of the ferrite members 18 and 20 decreases. Accordingly, insertion loss decreases, so that heat generation of the ferrite members 18 and 20 is suppressed. As a result, temperature rise of the ferrite members 18 and 20 is suppressed, even if a large amount of power is applied.

For this reason, decrease of saturation magnetization 4 πMs of the ferrite members 18 and 20 is suppressed in the waveguide circulator 30.

Moreover, even if a larger amount of power is applied in the waveguide circulator 30 to rise temperature of the ferrite members 18 and 20 so that return loss and isolation characteristics shift to a high frequency, deterioration of the characteristics is small, because its band is broad.

Thus, the waveguide circulator 30 is provided with the extended section 34 in such that a distance between the ferrite members 18 and 20 is adjusted dependent on a magnitude of electric power to be applied, and the impedance decreased as a result of the above-described adjustment is compensated. Accordingly, even if electric power to be applied becomes large, neither arcing phenomenon appears, nor deterioration of microwave characteristic arises.

The above-described embodiments may be modified as described in the following paragraphs (1) through (8).

Figure 10A:
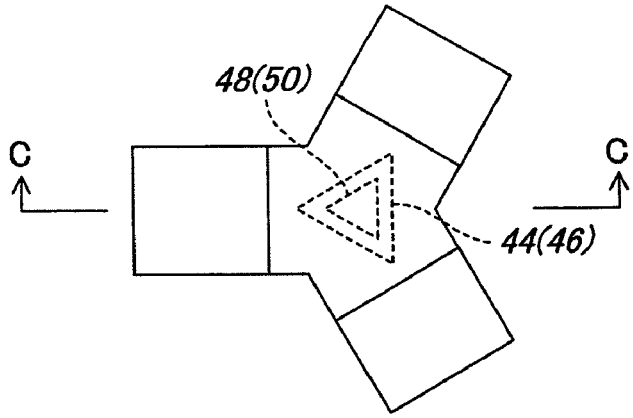
FIG. 10(*a*) is a plan explanatory view showing a modification of the waveguide circulator according to the invention.
Figure 10B:
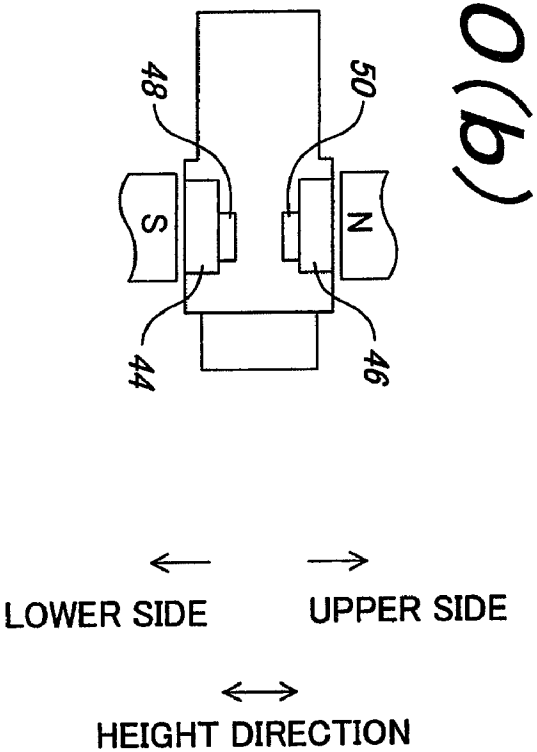

(1) Although the circular disc-shaped ferrite members 18 and 20 are adhesively fixed to the column-shaped pedestals 14 and 16, respectively, in the above-described embodiments, shapes of the pedestals and ferrite members are not limited thereto, as a matter of course. For example, substantially trigon-shaped ferrite members 48 and 50 may be adhesively fixed to substantially triangular prism-shaped pedestals 44 and 46, respectively, as shown in FIGS. 10(*a*) and 10(*b*).

Furthermore, the substantially trigon-shaped ferrite members 48 and 50 may be adhesively fixed to the column-shaped pedestals, 14 and 16, or the circular disc-shaped ferrite members 18 and 20 may be adhesively fixed to the substantially triangular prism-shaped pedestals 44 and 46, respectively.

Figures 11A, 11B, 11C, 11D:
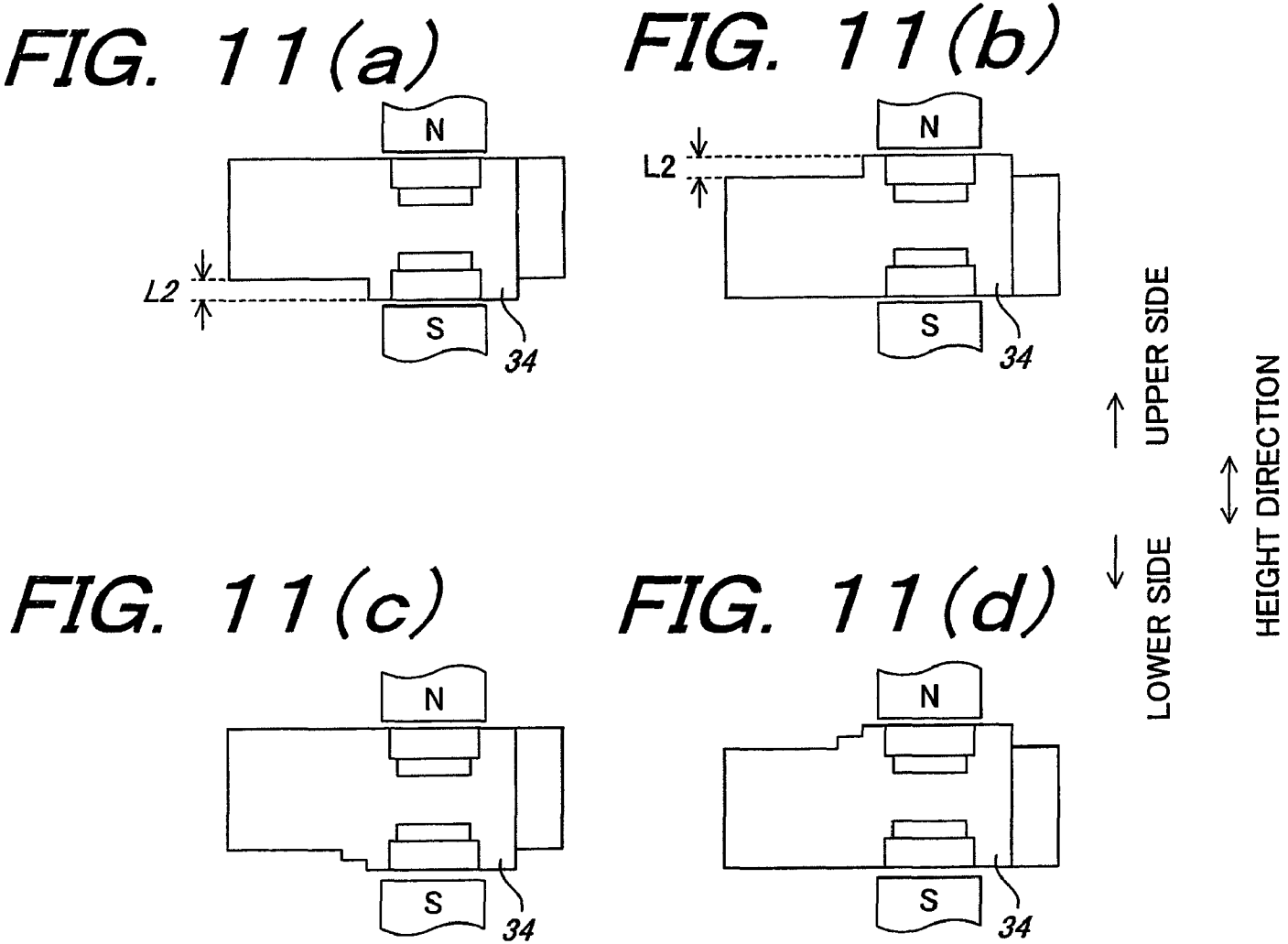
FIGS. 11(*a*), 11(*b*), 11(*c*), and 11(*d*) are sectional explanatory views each showing a modification of the waveguide circulator according to the invention.
Figure 12A:
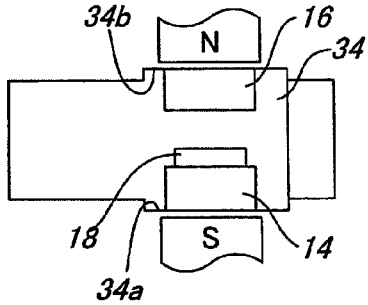
FIGS. 12(*a*), 12(*b*), 12(*c*), 12(*d*), 12(*e*), and 12(*f*) are sectional explanatory views each showing a modification of the waveguide circulator according to the invention.
Figure 12B:
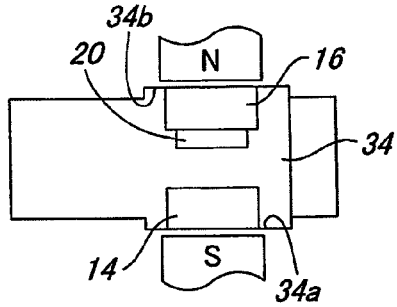
Figure 12C:
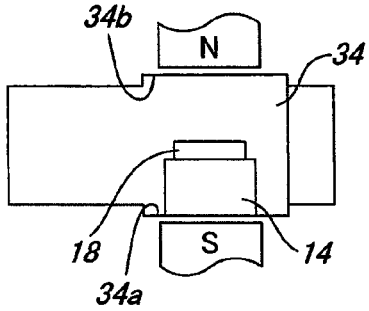
Figure 12D:
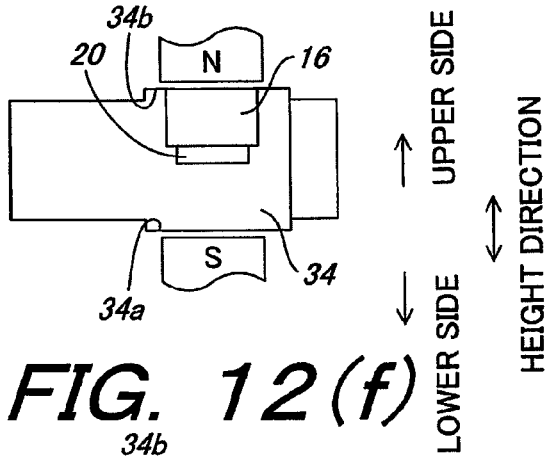
Figure 12E:
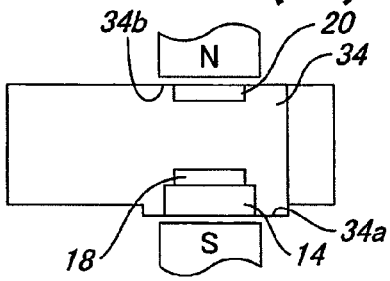
Figure 12F:
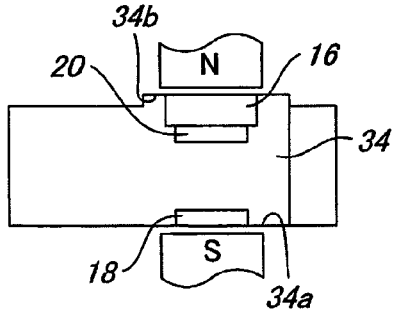

(2) Although the extended section 34 is formed by extending the length L1 toward the upper side and the lower side thereof, respectively, in the above-described embodiments, the extended section 34 may be formed by extending a length L2 which is twice longer than L1 toward either of the upper side and the lower side thereof (see FIGS. 11(*a*) and 11(*b*)).

Moreover, in the case that the extended section 34 is extended toward either of the upper side and the lower side, steps formed with the extended section 34 may be two or more (see FIGS. 11(*c*) and 11(*d*)).

As described above, when the steps formed with the extended section 34 is made to be two or more steps, it makes possible that unnecessary resonance mode does not appear, whereby deterioration of pass characteristic is prevented.

On one hand, in the case that a step formed with the extended section 34 is one, when a difference between impedance of the extended section 34 and impedance of the rectangular waveguides 32-1, 32-2, and 32-3 is remarkable, reflection becomes large, so that a frequency range which can be impedance-matched becomes a narrow band. However, when the steps formed with the extended section 34 is made to be two or more, it becomes possible that a difference between the impedance of the extended section 34 and that of the rectangular waveguides 32-1, 32-2, and 32-3 does cancel, so that the frequency range which can be impedance-matched makes possible to be broad.

In other words, when the steps formed with the extended section 34 are made to be two or more, it becomes possible that impedance-matching is made in a broad band.

(3) Although the ferrite member 18 is adhesively fixed to the pedestal 14 disposed on the undersurface 34*a* of the extended section 34, whilst the ferrite member 20 is adhesively fixed to the pedestal 16 disposed on the upper surface 34*b* of the extended section 34 in the above-described embodiments, an alignment of pedestals and ferrite members in the extended section 34 is not limited thereto, as a matter of course.

For example, it may be arranged in such that the pedestal 14 is disposed on the undersurface 34*a* of the extended section 34, and the ferrite member 18 is adhesively fixed to the pedestal 14, whilst the pedestal 16 is disposed on the upper surface 34*b* of the extended section 34, and the ferrite member 20 is not adhesively fixed to the pedestal 16 as shown in FIG. 12(*a*).

Alternatively, it may be arranged in such that the pedestal 14 is disposed on the undersurface 34*a* of the extended section 34, and the ferrite member 18 is not adhesively fixed to the pedestal 14, whilst the pedestal 16 is disposed on the upper surface 34*b* of the extended section 34, and the ferrite member 20 is adhesively fixed to the pedestal 16 as shown in FIG. 12(*b*).

Furthermore, it may be modified in such that the pedestal 14 is disposed on the undersurface 34*a* of the extended section 34, and the ferrite member 18 is adhesively fixed to the pedestal 14, whilst the pedestal 16 is not disposed on the upper surface 34*b* of the extended section 34, and the ferrite member 20 is not adhesively fixed also as shown in FIG. 12(*c*).

Moreover, it may be modified in such that neither the pedestal 14 is disposed on the undersurface 34*a* of the extended section 34, nor the ferrite member 18 is adhesively fixed also, whilst the pedestal 16 is disposed on the upper surface 34*b* of the extended section 34, and the ferrite member 20 is adhesively fixed to the pedestal 16 as shown in FIG. 12(*d*).

It is to be noted that a distance between the ferrite member 18 and the pedestal 16 is designed so as not to appear arcing phenomenon in FIG. 12(*a*); that a distance between the pedestal 14 and the ferrite member 20 is designed so as not to appear arcing phenomenon in FIG. 12(*b*); that a distance between the ferrite member 18 and the upper surface 34*b* of the extended section 34 is designed so as not to appear arcing phenomenon in FIG. 12(*c*); and that a distance between the undersurface 34*a* of the extended section 34 and the ferrite member 20 is designed so as not to appear arcing phenomenon in FIG. 12(*d*).

Furthermore, it may be arranged in such that the pedestal 14 is disposed on the undersurface 34*a* of the extended section 34, and the ferrite member 18 is adhesively fixed to the pedestal 14, whilst the pedestal 16 is not disposed on the upper surface 34*b* of the extended section 34, but the ferrite 20 is adhesively fixed in the position opposed to the ferrite member 18 as shown in FIG. 12(*e*).

Alternatively, it may be modified in such that the pedestal 14 is not disposed on the undersurface 34*a* of the extended section 34, but the ferrite member 18 is adhesively fixed in the position opposed to the ferrite member 20, whilst the pedestal 16 is disposed on the upper surface 34*b* of the extended section 34, and the ferrite member 20 is adhesively fixed to the pedestal 16 as in FIG. 12(*f*).

It is to be noted that the extended section 34 is arranged so as to extend only toward the direction along which the pedestal is disposed in a case of examples shown in FIGS. 12(*e*) and 12(*f*).

(4) Although the extended section 34 is arranged so as to extend in the positions opposed to the undersurface 32*a* and the upper surface 32*b* of the waveguide 32, so that positions of steps produced by providing the extended section 34 in the waveguide 32 are allocated to a region opposed thereto in the above-described embodiments, the present invention is not limited thereto, as a matter of course.

Figure 13A:
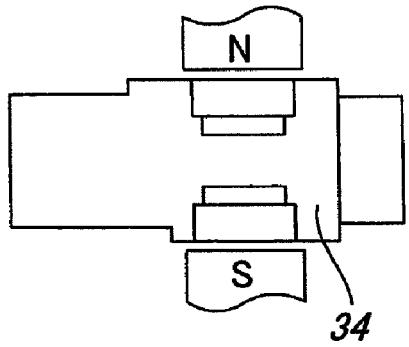
FIGS. 13(*a*) and 13(*b*) are sectional explanatory views each showing a modification of the waveguide circulator according to the invention.
Figure 13B:
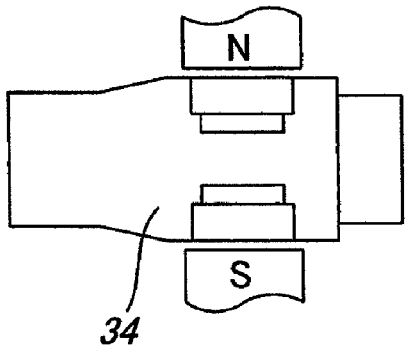

For, example, the extended section 34 may be formed in such that positions of the steps produced by providing the extended section 34 in the waveguide 32 are not allocated to a region which is opposed exactly to each other on both the sides of the upper surface and the undersurface as shown in FIG. 13(*a*).

Since the extended section 34 is formed as described above, electric field concentrated in edge parts of steps in the extended section 34 increases intensity thereof in the upper and under different positions in even such a case that an unexpected large amount of power is applied, and accordingly, it becomes difficult to appear arcing phenomenon.

Alternatively, steps produced by providing the extended section 34 may be tapered as shown in FIG. 13(*b*).

When the extended section 34 is formed as shown in FIG. 13(*b*), the extended section 34 does not define steps, so that there is no place where electric field concentrates. Accordingly, even if an unexpected large amount of power is applied, it becomes difficult to appear an arcing phenomenon.

(5) Although such a case that the present invention is applied to a substantially Y-shaped circulator having three junctions is explained in the above-described embodiments, the invention is not limited thereto, as a matter of course. For example, the invention may be applied to a multistage circulator in which many ferrite members are used, a ferrite phase-shifting section of a phase-shift circulator, or the like.

(6) Although the S-pole magnet 22 and the N-pole magnet 24 are placed outside the waveguide 32 so as not to be in contact with the outer circumferential surface 32*c* of the waveguide 32 in the above-described embodiments, the invention is not limited thereto, as a matter of course, and the S- and N-pole magnets may be placed so as to be in contact with the outer circumferential surface 32*c* of the waveguide 32.

(7) Although the S-pole magnet 22 is placed under the lower side of the extended section 34, whilst the N-pole magnet 24 is placed over the upper side of the extended section 34 in the above-described embodiments, the invention is not limited thereto, as a matter of course, and the S-pole magnet 22 may be placed over the upper side of the extended section 34, whilst the N-pole magnet 24 may be placed under the lower side of the extended section 34.

(8) The above-described embodiments and the modifications described in the above paragraphs (1) to (7) may be optionally combined with each other.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

The entire disclosure of Japanese Patent Application No. 2009-28110 filed on Feb. 10, 2009 including specification, claims, drawing and summary are incorporated herein by reference in its entirety.

What is claimed is:

1. A waveguide circulator composed of a waveguide formed substantially in Y-shape with rectangular waveguides which are provided so as to position horizontally on a predetermined plane, and further they are extended in different three directions from junction positions of the waveguide wherein two ferrite members are placed in the junction positions thereof so as to oppose to each other on the upper and lower sides in the height direction perpendicular to the predetermined plane; comprising:

an extended section extending in the height direction in the vicinities of the junction positions of the waveguides being formed; and a distance between the ferrite members being expanded to compensate decreased impedance wherein:

at least one of the ferrite members is adhesively fixed to a pedestal disposed in the junction positions of the waveguide.

2. The waveguide circulator as claimed in claim 1, wherein:

the extended section is extended in the height direction in positions apart from the center of the junction positions by ⅛ λg to λg (λg: guide wavelength of a rectangular waveguide) in the respective rectangular waveguides.

3. The waveguide circulator as claimed in claim 1, wherein:

the extended section is extended in the height direction in the vicinities of the junction positions of the waveguide to form steps on the upper and lower sides of the waveguide; and the steps are formed into a tapered shape.

4. The waveguide circulator as claimed in claim 1, wherein:

the extended section is extended in the height direction in the vicinities of the junction positions of the waveguide to form steps on the upper and lower sides of the waveguide; and the steps are positioned so as not to oppose to each other.

5. The waveguide circulator as claimed in claim 1, wherein:

a cooling medium is provided on the outer circumferential surface of the waveguide.

6. The waveguide circulator as claimed in claim 1, wherein:

the extended section is extended in the height direction toward only either one of the upper and lower sides.

7. The waveguide circulator as claimed in claim 6, wherein:

the extended section is extended in the height direction in the vicinities of the junction positions of the waveguide to form a step on either one of the upper and lower sides of the waveguide; and the step is formed to be a plurality of steps.

8. A waveguide circulator composed of a waveguide formed substantially in Y-shape with rectangular waveguides which are provided so as to position horizontally on a predetermined plane, and further they are extended in different three directions from junction positions of the waveguide wherein a ferrite member is disposed on either of pedestals placed on the upper and lower sides in the height direction perpendicular to the predetermined plane in the junction positions thereof; comprising:

an extended section extending in the height direction in the vicinities of the junction positions of the waveguides being formed; and a distance between the ferrite member and the pedestal opposed thereto being expanded to compensate decreased impedance.

9. The waveguide circulator as claimed in claim 8, wherein:

the extended section is extended in the height direction in positions apart from the center of the junction positions by ⅛ λg to λg (λg: guide wavelength of a rectangular waveguide) in the respective rectangular waveguides.

10. The waveguide circulator as claimed in claim 8, wherein:

the extended section is extended in the height direction in the vicinities of the junction positions of the waveguide to form steps on the upper and lower sides of the waveguide; and the steps are formed into a tapered shape.

11. The waveguide circulator as claimed claim 8, wherein:

the extended section is extended in the height direction in the vicinities of the junction positions of the waveguide to form steps on the upper and lower sides of the waveguide; and the steps are positioned so as not to oppose to each other.

12. The waveguide circulator as claimed in claim 8, wherein:

a cooling medium is provided on the outer circumferential surface of the waveguide.

13. The waveguide circulator as claimed in claim 8, wherein:

the extended section is extended in the height direction toward only either one of the upper and lower sides.

14. The waveguide circulator as claimed in claim 13, wherein:

the extended section is extended in the height direction in the vicinities of the junction positions of the waveguide to form a step on either one of the upper and lower sides of the waveguide; and the step is formed to be a plurality of steps.

15. A waveguide circulator composed of a waveguide formed substantially in Y-shape with rectangular waveguides which are provided so as to position horizontally on a predetermined plane, and further they are extended in different three directions from junction positions of the waveguide wherein a ferrite member is disposed on either of pedestals placed on the upper and lower sides in the height direction perpendicular to the predetermined plane in the junction positions thereof; comprising:

an extended section extending in the height direction in the vicinities of the junction positions of the waveguides being formed; and a distance between the ferrite member and an inner circumferential surface of the extended section opposed the ferrite member being expanded to compensate decreased impedance.

16. The waveguide circulator as claimed claim 15, wherein:

the extended section is extended in the height direction in positions apart from the center of the junction positions by ⅛ μg to λg (λg: guide wavelength of a rectangular waveguide) in the respective rectangular waveguides.

17. The waveguide circulator as claimed in claim 15, wherein:

the extended section is extended in the height direction in the vicinities of the junction positions of the waveguide to form steps on the upper and lower sides of the waveguide; and the steps are formed into a tapered shape.

18. The waveguide circulator as claimed in claim 15, wherein:

the extended section is extended in the height direction in the vicinities of the junction positions of the waveguide to form steps on the upper and lower sides of the waveguide; and the steps are positioned so as not to oppose to each other.

19. The waveguide circulator as claimed in claim 15, wherein:

a cooling medium is provided on the outer circumferential surface of the waveguide.

20. The waveguide circulator as claimed in claim 15, wherein:

the extended section is extended in the height direction toward only either one of the upper and lower sides.

21. The waveguide circulator as claimed in claim 20, wherein:

the extended section is extended in the height direction in the vicinities of the junction positions of the waveguide to form a step on either one of the upper and lower sides of the waveguide; and the step is formed to be a plurality of steps.

* * * * *